US005451183A

United States Patent [19]

Dahlin

[11] Patent Number: 5,451,183

[45] Date of Patent: Sep. 19, 1995

[54] FURNACE BREATHING FILTER

[76] Inventor: Bernard A. Dahlin, 1737 Carriage Ct., Green Bay, Wis. 54304

[21] Appl. No.: 270,447

[22] Filed: Jul. 5, 1994

[51] Int. Cl.[6] ..... F23L 17/02

[52] U.S. Cl. ..... 454/3; 55/505; 126/85 B; 454/8

[58] Field of Search ..... 55/505; 126/85 B; 454/3, 8, 367, 368

[56] References Cited

U.S. PATENT DOCUMENTS

| | | | |
|---|---|---|---|
| D 249,955 | 10/1978 | Vogelsang | D23/42 |
| 2,524,588 | 10/1950 | Bechtel | 55/505 |
| 2,811,095 | 10/1957 | Moran | 454/8 |
| 2,878,744 | 3/1959 | Silverman | 454/3 X |

FOREIGN PATENT DOCUMENTS

| | | | |
|---|---|---|---|
| 1467324 | 1/1967 | France | 55/505 |
| 579027 | 7/1946 | United Kingdom | 454/3 |

*Primary Examiner*—Harold Joyce
*Attorney, Agent, or Firm*—Donald Cayen

[57] ABSTRACT

A furnace breathing filter protects the air inlet and exhaust gas outlet tubes of high-efficiency furnaces from plugging while enabling adequate gas flow. The furnace breathing filter comprises a filter section and a hub. The hub is designed to be inserted into and secured to a fitting on the outdoor end of the furnace tube. The filter section has a grid of openings that are sufficiently large to enable adequate gas passage but small enough to block entry of foreign materials into the furnace tube. The hub may be joined integrally with the filter section, or it maybe a separate piece that is removably assembled to the filter section. The hubs are made with different outer diameters to suit different sized furnace tubes. In an alternate design, the hub fits over the furnace tube fitting.

6 Claims, 3 Drawing Sheets

FIG. 9
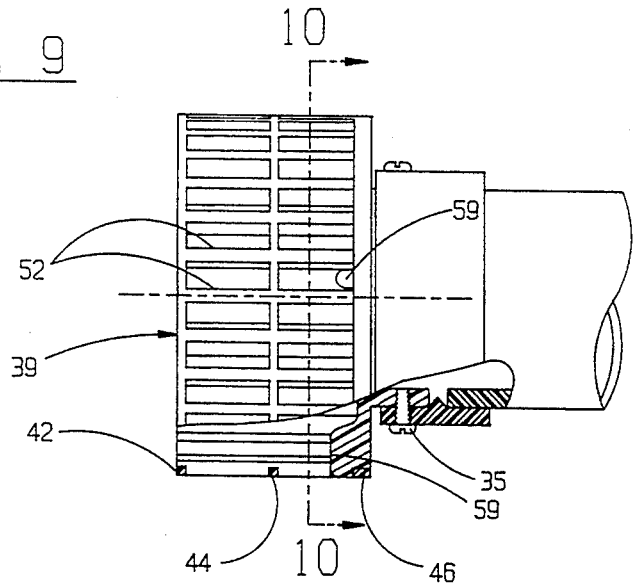
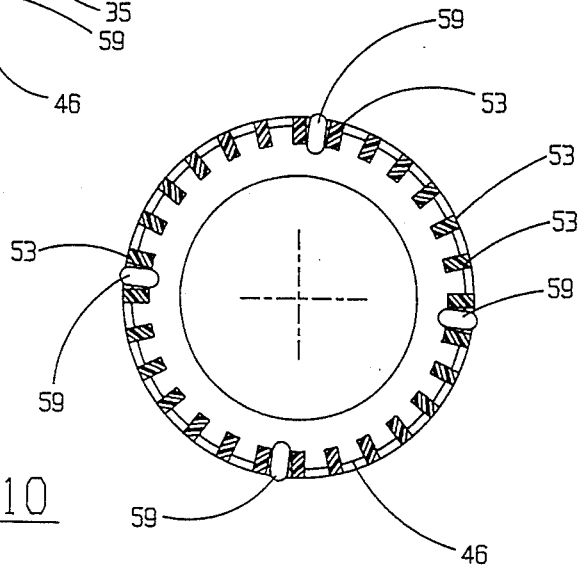
FIG. 10
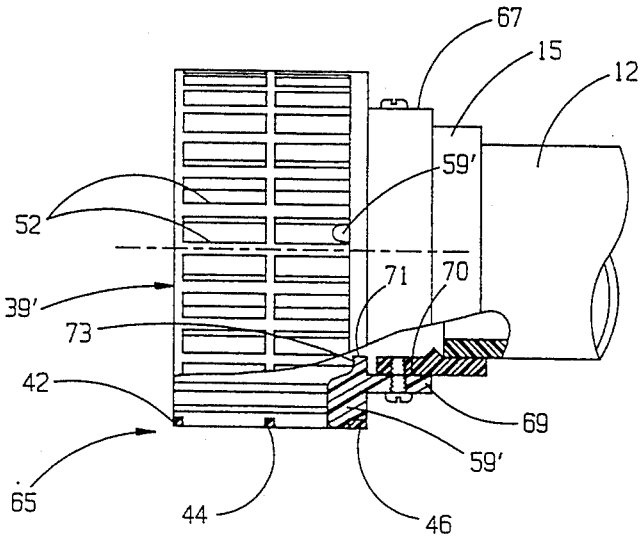
FIG. 11

FURNACE BREATHING FILTER

BACKGROUND OF THE INVENTION

1. Field of the Invention

This invention pertains to filters, and more particularly to apparatus for preventing foreign materials from entering furnaces.

2. Description of the Prior Art

Modern high-efficiency furnaces are well known and are in widespread use. Their economical and reliable operation contributes to their popularity.

Intake air for a high-efficiency furnace is usually drawn directly from out-of-doors. The inlet air flows through an inlet tube that passes through a building wall and connects to the furnace. Similarly, exhaust gasses from the furnace flow through an outlet tube that terminates out-of-doors, usually close to the inlet end of the inlet tube. The outdoor ends of the inlet and outlet tubes are normally located within a few feet of ground level outside the building. The tubes vary in size, with two inch diameter tubes being satisfactory for most residences, and a three inch tube usually being required for commercial and industrial applications.

Despite their general acceptance, high-efficiency furnaces have a drawback that occasionally causes rather serious problems: the inlet and outlet tubes are susceptible to plugging. Common reasons for the tubes becoming plugged include leaves or other debris blowing into them. Birds are another a problem; birds have been known to fly into furnace tubes and getting killed upon reaching the furnace. Another source of plugging is children tossing stones or other items into the tubes.

When a tube becomes plugged, sensors on the furnace automatically shut it off. It is then necessary to service the furnace. The only practical way to unplug a tube is to cut it in order to reach the plugged section. Then the cut tube must be patched or replaced. The inconvenience and expense caused by a plugged tube are highly aggravating.

In an attempt to prevent furnace tubes from plugging, it is known to install strip-like strainers at their outdoor ends. However, the prior strainers are not entirely satisfactory. A disadvantage of the prior strainers is that they are recessed into the tube ends. The space between a tube end and a strainer can become filled with leaves and the like and thereby plug the tube. Although the leaves or other material can be removed fairly easily, the task of doing so, plus restarting the furnace, is nevertheless an annoyance. Another disadvantage of the prior strainers is that they reduce the area for the flowing gasses. Consequently, there is an increased likelihood that even a partially plugged strainer will cause the furnace to shut down.

Thus, a need exists for improvements in filters for modern furnaces.

SUMMARY OF THE INVENTION

In accordance with the present invention, a simple and economical furnace breathing filter is provided that solves the problems associated with providing air to and removing exhaust gasses from a high-efficiency furnace. This is accomplished by apparatus that includes high capacity filters placed on the outdoor ends of the furnace air inlet and exhaust gas outlet tubes.

The furnace breathing filter is comprised of two sections: a filter section and a hub. The filter section is designed with a gas flow capacity that suits the largest furnace that is anticipated to employ the invention. In the preferred embodiment, the filter section is generally tubular in shape, and the circumferential wall is formed as a grid. An end wall of the filter section is also formed as a grid.

The hub is integrally joined to a second end wall of the filter section. The hub is designed to fit one size of furnace tube. For that purpose, the hub has a collar with an outer diameter that is assembled to the furnace tube by fitting snugly inside a fitting at the outdoor end of a furnace tube. Alternately, the hub collar may be designed to fit on the outside of the end fitting of the furnace tube. Furnace tubes of different sizes require furnace breathing filters with different diameter collars.

The filter section and hub of the invention are designed to allow inlet air or exhaust gases to flow through them without restriction. At the same time, a furnace tube becomes almost impossible to plug with a furnace breathing filter in place.

In a modified embodiment of the present invention, the filter section and hub are fabricated as two individual components. In that design, a single filter section is used with interchangeable hubs. The filter section has a circumferential grid and one end wall that is also a grid. Each hub has a flange and a collar. The flange is assemblable to a second end of the filter section so as to form an annular second wall. The collars of different hubs have different diameters to suit different size furnace tubes. The collars may fit on either the inside or the outside of the furnace tube end fittings.

The apparatus and method of the invention, using filters located on the outdoor ends of furnace air inlet and exhaust gas tubes, thus prevents the tubes from plugging. The possibility of a furnace shutdown due to a plugged tube is remote even if a portion of the filter section should become covered with debris.

Other advantages, benefits, and features of the present invention will become apparent to those skilled in the art upon reading the detailed description of the invention.

BRIEF DESCRIPTION OF THE DRAWINGS

FIG. 9 is a partially broken front view of the furnace breathing filter of FIG. 7 in its assembled condition.

FIG. 10 is a cross sectional view taken along line 10—10 of FIG. 9.

FIG. 11 is a view similar to FIG. 9, but showing a furnace breathing filter with a hub that fits on the outside of a furnace tube fitting.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
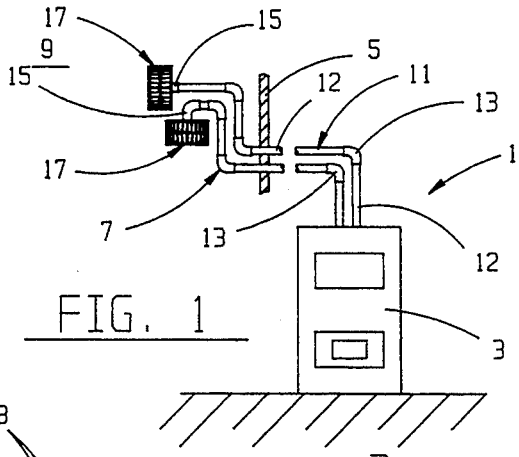
FIG. 1 is a simplified view of a typical furnace installation that advantageously includes the present invention.
Figure 3:
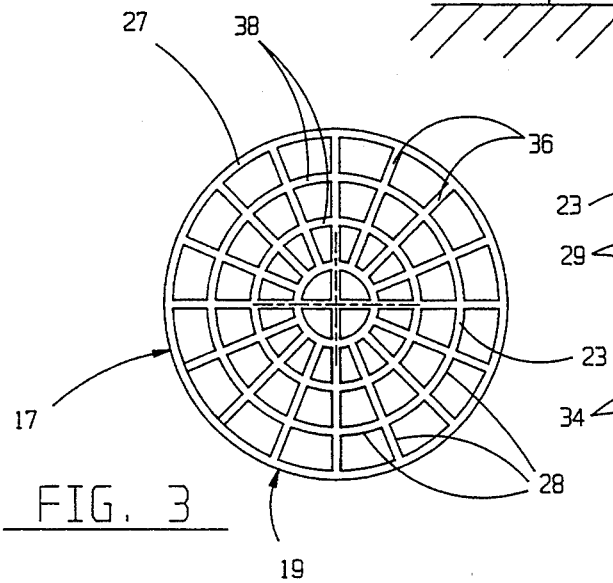
FIG. 3 is a view taken along line 3—3 of FIG. 2.
Figure 2:
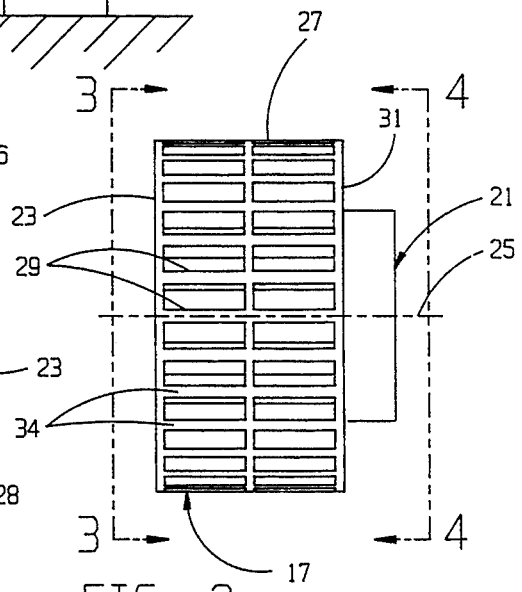
FIG. 2 is a front view of the furnace breathing filter of the present invention.
Figure 4:
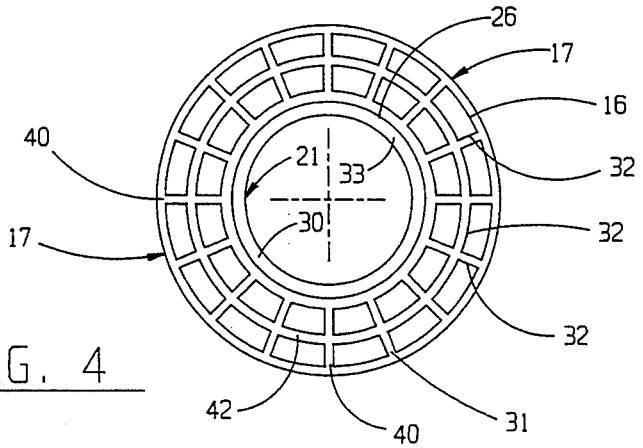
FIG. 4 is a view taken along line 4—4 of FIG. 2.
Figure 5:
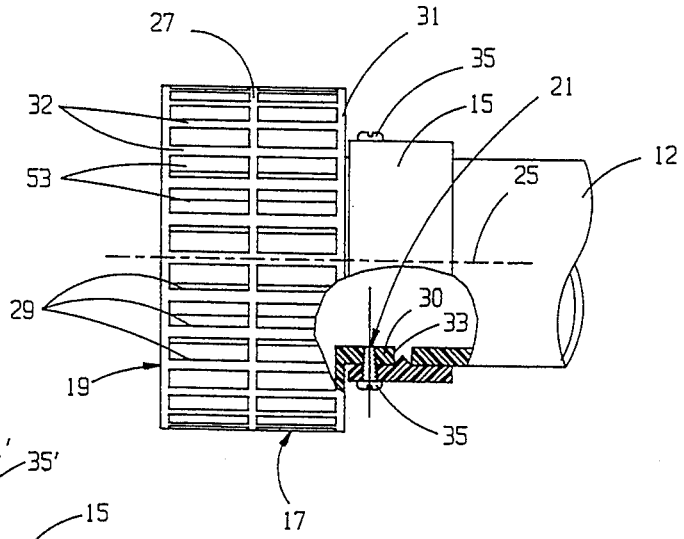
FIG. 5 is a partially broken front view of the furnace breathing filter installed in a furnace tube.

FIG. 1 shows in simplified form a modern high-efficient furnace installation 1 that includes the present invention. The installation 1 typically includes a gas or oil burning furnace 3 located inside a building wall 5. An air inlet tube 7 supplies the furnace 3 with fresh air from the atmosphere 9 outside the building wall 7. An exhaust tube 11 vents exhaust gases from the furnace to the atmosphere 9.

The inlet tube 7 and exhaust tube 11 are typically made from a polyvinylchloride plastic material, as is known in the art. Individual pieces of tubing 12 are cut and joined by various fittings 13 to suit the particular installation 1 and building wall 5. The inlet and exhaust tubes invariably terminate at their outdoor ends in known fittings such as couplings or elbows 15.

In accordance with the present invention, a breathing filter 17 for the furnace 3 is installed on the outdoor ends of the inlet tube 7 and the exhaust tube 11. Looking also at FIGS. 2–5, the furnace breathing filter 17 is comprised of a filter section 19 and an integral hub 21 that together define an axial centerline 25. In the preferred embodiment, the filter section 19 is generally tubular in shape, having an end wall 23 and a circumferential wall 27. Both the end wall 23 and the circumferential wall 27 define any of a number of patterns of grid openings 28 and 29, respectively, therein. Opposite the end wall 23 of the filter section 19 is an annular second wall 31. The annular second wall 31 may be solid, or it may define a grid of openings 32 therethrough.

The hub 21 of the furnace breathing filter 17 is made as a short collar 30 having one end that joins the annular wall 31 of the filter section 19 and a free end 33. The collar 30 has an outer diameter 26 that fits snugly into the end fitting 15 of a furnace tube 7 or 11. To suit different diameter tubes, the furnace breathing filter is manufactured with collars of different outer diameters 26. For example, for a two inch nominal size tube 7 or 11, the outer diameter of the hub collar is approximately 2.38 inches. For a three inch nominal size tube 7 or 11, the outer diameter of the collar 30 is approximately 3.50 inches. Other dimensions for the furnace breathing filter include a diameter of approximately 5.00 inches and a length of approximately 2.75 inches for the filter section 19.

The grid openings 28 of the end wall 23 may be formed by 16 radially extending ribs 36 joined to several circular ribs 38. The ribs 36 and 38 may be approximately 0.25 inches wide and 0.09 inches thick. The grid openings 29 are defined by a number of axially extending circumferentially spaced ribs 34. I have found that 32 ribs 34, each having a width of approximately 0.25 inches and a thickness of approximately 0.09 inches, works very well. The grid 32 of the annular wall 31 has partial radial ribs 40 and a circular rib 42 that are substantially similar to the corresponding portions of the radial and circular ribs 36 and 38, respectively, of the grid 28 of the end wall 23. A satisfactory length for the hub is approximately 0.75 inches, as is a wall thickness of approximately 0.19 inches.

In use, a furnace breathing filter 17 is chosen that has a hub 21 that suits the size of the furnace tube 7 or 11 with which it is to be used. The furnace breathing filter is assembled to a tube by inserting the hub collar 30 into the open end of a furnace tube end fitting 15. Although the hub may be cemented into the tube end section, I prefer that the furnace breathing filter be retained in place with one or two screws 35.

With the furnace breathing filters 17 in place on the tubes 7 and 11, inlet air and exhaust gasses are free to flow through the filter sections 19 without restriction and in sufficient quantities to satisfy the furnace 3. At the same time, the furnace breathing filters prevent the tubes 7 and 11 from plugging, whether due to natural or intentional causes.

Figure 6:
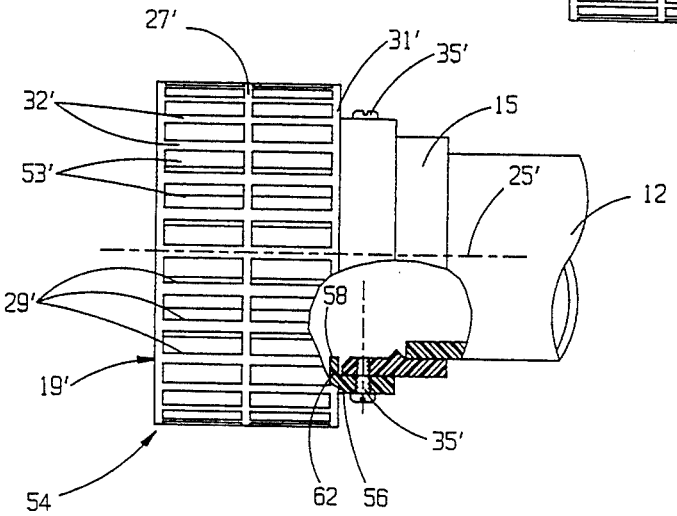
FIG. 6 is a view similar to FIG. 5, but showing an alternate construction for the hub of the furnace breathing filter.
Figure 7:
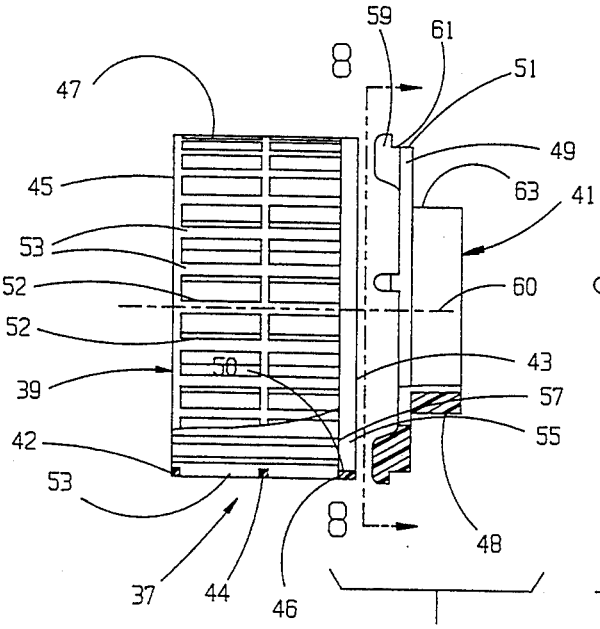
FIG. 7 is an exploded and partially broken front view of a modified embodiment of the present invention.
Figure 8:
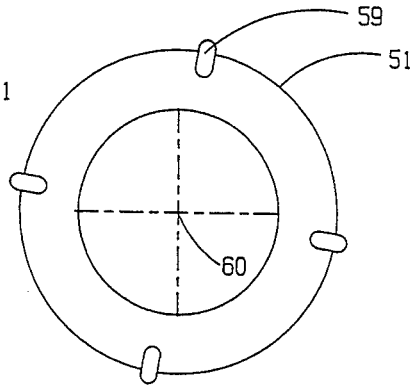
FIG. 8 is a view taken along line 8—8 of FIG. 7.

FIG. 6 shows a furnace breathing filter 54 that has an alternate design for the hub 56. The furnace breathing filter 54 has a filter section 19' that is substantially similar to the filter section 19 described previously in connection with FIGS. 1–5. The filter section 19' includes an annular wall 31'. The inner diameter 8 of the annular wall 31' is approximately the same size as the inner diameter of the end fitting 15 of the furnace tube 12. The annular wall 31' may be solid, or it may have a grid of openings therethrough. The hub 56 is made as a short collar that is integral with the annular wall 31'. The hub collar has an inner diameter that fits over the outer diameter of the end fitting 15. An inner diameter of approximately 2.75 inches for the hub collar works very well for two-inch nominal size furnace tubes 7, 11 (FIG. 1). The portion of the annular wall 31' between its inner diameter 58 and the inner diameter of the hub collar forms a shoulder 62. The shoulder 62 assures proper location of the furnace breathing filter 54 on the end fitting 15. The furnace breathing filter 54 is retained to the end fitting 15 with screws 35'.

Now turning to FIGS. 7–10, a furnace breathing filter 37 is shown that is made of two separate components, a filter section 39 and a mounting hub 41. The filter section 39 is tubular in shape, having one end 43 that is completely open. The opposite wall 45 is fabricated as a grid that may be similar to the grid 28 of the filter section 19 of the furnace breathing filter 17 described previously. The filter section 39 of the two-piece furnace breathing filter 37 also has a circumferential wall 47 having a grid 52 that may be substantially similar to the circumferential grid 29 of the furnace breathing filter 17. As illustrated, the circumferential wall 47 is partially defined by annular rings 42, 44, and 46, each having an inner diameter 50. Circumferentially spaced, axially extending ribs 53 connect the rings 42, 44, and 46. The ribs 53 do not extend all the way to the filter section end 43; there is a space 55 between the ends 57 of the ribs and the filter section end 43. A nominal diameter of 5 inches and a nominal axial length of 2.75 inches for the filter section are satisfactory.

The mounting hub 41 of the furnace breathing filter 37 is comprised of a collar 48 and an outturned flange 49 at one end of the collar. The outer diameter 51 of the flange 49 is slightly less than the inner diameter 50 of the filter section ring 46. Circumferentially spaced around the flange 49 of the hub 41 are several tabs 59. The tabs 59 radiate from the centerline 60 and overhang the flange outer diameter 51. Each tab has a notch 61 at its outer end.

The mounting hub 41 is manufactured in different sizes to suit different tubes 7 and 11 of the furnace installation 1, FIG. 1. Specifically, the collar 48 is made with an outer diameter 63 that fits into the end fittings 15 of the furnace tubes 7 and 11. For example, the outer diameter 63 of the collar is approximately 2.38 inches for two inch furnace tubes, and approximately 3.50 inches for three inch furnace tubes. On the other hand, the outer diameter 51 of the flange 49 and the tabs 59 are the same for all hubs 41. Similarly, a length of approximately 0.75 inches and a wall thickness of approximately 0.19 inches for the collar 48 is satisfactory for all hubs. The mounting hub 41 shown in FIGS. 7–10 has relative dimensions suitable for use with two-inch furnace tubes. In that situation, the flange may be fabricated with grid openings that are similar to the grid openings 32 of the filter 17, FIG. 4. For hubs used with three-inch furnace tubes, the flange 49 is solid.

The filter section 39 and the mounting hub 41 of the furnace breathing filter 37 are preferably manufactured from a relatively soft polyethylene plastic material. The filter section is designed to be flexible enough to enable the hub tabs 59 to slide past the ring 46 of the filter section such that the notches 61 of the tabs 59 lock over the ring 46. In that manner, a single filter section can be used interchangeably with different hubs that suit the tubes 7 and 11. Mounting of the two piece furnace breathing filter 37 to the tubes 7 and 11 may be the same as for the single piece furnace breathing filter 17 described previously in connection with FIGS. 1–5.

In FIG. 11, a furnace breathing filter 65 has a filter section 39' that is substantially similar to the filter section 39 described above and a hub 67. The hub 67 has a flange 49' and a collar 69. The collar 69 of the hub 67 has an inner diameter 70 that fits over the furnace tube end fitting 15. The flange 49' has an inner diameter 71 that is approximately the same size as the inner diameter of the fitting 15 such that there is a shoulder 73 between the flange inner diameter 71 and the collar inner diameter 70. The furnace breathing filter 65 is assembled and used in the same manner as the furnace breathing filter 37 described above in connection with FIGS. 7–10.

In summary, the results and advantages of modern high-efficiency furnaces 3 can now be more fully realized. The furnace breathing filters 17, 37, 54, and 65 of the present invention provide both adequate flow for inlet air and exhaust gasses while protecting against plugging of the furnace tubes 7 and 11. This desirable result comes from using the combined functions of a filter section 19, 19' or 39, 39' and a hub 21, 41, 56, or 67. The filter section and hub can be one integral part, in which case the hub is manufactured with different outer diameters to suit different furnace installations. Alternately, the filter section and hub can be separate pieces to enable a single filter section to be interchangeably assembled with different hubs that are sized to suit different furnace installations 1. The hubs may be designed to fit either into or over the end fittings of the furnace tubes.

It will also be recognized that in addition to the superior performance of the furnace breathing filters 17 and 37, their construction is such as to be of minimal cost. Accordingly, they represent a value that is far greater than their cost relative to the cost of a complete furnace installation 1. Also, the furnace breathing filters are made of rugged designs and materials, so the need for maintenance is practically non-existent.

Thus, it is apparent that there has been provided, in accordance with the invention, a furnace breathing filter that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A filter comprising:

a. a filter section having a cylindrical wall that defines a first grid, a flat first end wall that defines a second grid, and a flat second end wall that defines a third grid; and b. a hub joined to the filter section second end wall and comprising a collar having a predetermined outer diameter that is insertable snugly into an end of a selected tube, the hub cooperating with the filter section to enable air to flow practically without restriction therethrough and through the selected tube while preventing the tube from plugging with foreign materials.

2. In combination with a furnace installation having tubes for air inlet and exhaust gas, apparatus for preventing plugging of the tubes comprising:

a. a hub formed as a collar having a predetermined outer diameter, a first end inserted into an end of a tube, and a second end projecting from the tube; and b. a filter section having a flat annular end wall joined to the hub second end, a flat second end wall, and a cylindrical wall joining the annular and second end walls, each of the annular and second end walls and the cylindrical wall defining a plurality of air passages therethrough.

3. A furnace breathing filter comprising:

a. a filter section formed as a cylindrical wall with an end ring and defining a first grid that enables air to flow freely therethrough, and a flat end wall opposite the cylindrical wall end ring that defines a second grid that enables air to flow freely therethrough; and b. a hub comprising:

i. a collar having a predetermined inner diameter;

ii. a flat flange joined to the collar and having an opening therethrough concentric with the collar inner diameter and an outer diameter; and iii. a plurality of tabs on the hub flange that overhang the outer diameter thereof, the tabs cooperating with the end ring of the filter section cylindrical wall to assemble the hub to the filter section cylindrical wall opposite the end wall, so that the filter section and the hub cooperate to enable air to flow through the filter section grid and through the hub while preventing passage of unwanted materials.

4. A furnace breathing filter comprising:

a. a filter section formed as a circumferential wall defining a first grid that enables air to flow freely therethrough, and an end wall that defines a second grid that enables air to flow freely therethrough; and b. a hub comprising:

i. a collar having a predetermined inner diameter, wherein the hub collar has a predetermined outer diameter that is insertable into an end of a first selected tube; and ii. a flange joined to the collar and having an opening therethrough concentric with the collar inner diameter, wherein the hub flange defines a third grid that enables air to flow freely therethrough; and iii. tab means for assembling the hub to the filter section circumferential wall opposite the end wall, so that the filter section and the hub cooperate to enable air to flow through the filter section grid and through the hub while preventing passage of unwanted materials.

5. In combination with a furnace installation having a tube for the passage of air therethrough to a furnace, a furnace breathing filter for preventing the furnace installation tube from plugging with foreign materials comprising:

a. a filter section comprising:

i. a circumferential wall having first and second ends and defining a first grid for the passage of air therethrough; and ii. an end wall joined to the circumferential wall first end and defining a second grid for the passage of air therethrough; and b. a hub comprising:

i. collar means snugly insertable into the furnace installation tube for enabling passage of air therethrough; and ii. flange means joined to the collar means for removably assembling the hub to the filter section to enable air to pass through the furnace installation tube while preventing the tube from plugging with foreign materials, wherein the flange means comprises:

a flange joined to and outturned from the hub collar means, and wherein the flange defines a third grid for the passage of air therethrough; and tab means on the flange for cooperating with the filter section circumferential wall to removably assemble the hub to the filter section.

6. In combination with a furnace installation having a tube for the passage of air therethrough to a furnace, a furnace breathing filter for preventing the furnace installation tube from plugging with foreign materials comprising:

a. a filter section comprising:

i. a cylindrical wall having first and second ends with an annular ring at the second end and defining a first grid for the passage of air therethrough; and ii. a flat end wall joined to the circumferential wall first end and defining a second grid for the passage of air therethrough; and b. a hub comprising:

i. a collar fittable over the end of the furnace installation tube;

ii. a flat flange joined to the collar and having an outer diameter;

iii. a plurality of tabs on the flange overhanging the outer diameter thereof, the tabs cooperating with the annular ring on the cylindrical wall to removably assemble the hub to the filter section to enable air to pass through the furnace installation tube while preventing the tube from plugging with foreign materials; and iv. shoulder means formed on the flange means for properly locating the hub on the furnace installation tube.

* * * * *